United States Patent [19]

Wüthrich

[11] Patent Number: 5,015,809

[45] Date of Patent: May 14, 1991

[54] VACUUM SWITCH ARRANGEMENT

[75] Inventor: Hans R. Wüthrich, Oberentfelden, Switzerland

[73] Assignee: Sprecher Energie AG, Oberentfelden, Switzerland

[21] Appl. No.: 361,257

[22] Filed: Jun. 5, 1989

[30] Foreign Application Priority Data

Jun. 14, 1988 [CH] Switzerland ..... 02283/88

[51] Int. Cl.[5] ..... H01H 9/30

[52] U.S. Cl. ..... 200/144 R; 200/144 B

[58] Field of Search ..... 200/144 B, 144 R

[56] References Cited

U.S. PATENT DOCUMENTS

| | | | |
|---|---|---|---|
| 3,560,682 | 2/1971 | Kohler | 200/144 B |
| 4,104,496 | 8/1978 | Koike et al. | 200/144 B |
| 4,449,021 | 5/1984 | Wakayama et al. | 200/144 B |
| 4,587,390 | 5/1986 | Gray | 200/144 B |

FOREIGN PATENT DOCUMENTS

| | | | |
|---|---|---|---|
| 0060054 | 9/1982 | European Pat. Off. | 200/144 B |

OTHER PUBLICATIONS

"Medium Voltage Vacuum Contactors", (Bergamo, IT), SACE, Cat 8-0/ 12-1980, pp. 1-8.

*Primary Examiner*—George Harris

*Attorney, Agent, or Firm*—Fleit, Jacobson, Cohn, Price, Holman & Stern

[57] ABSTRACT

A switch arrangement includes three identical insulating support frames in the tubular insulating housings of which one vacuum switching tube each is arranged. Parallel insulating wall elements, at which support elements are molded for drive parts of a spring force drive, project from the insulating housings. An output shaft of the spring force drive is supported at all insulating wall elements while the remaining drive parts are arranged at the insulating wall elements of the center insulating support frame.

6 Claims, 1 Drawing Sheet

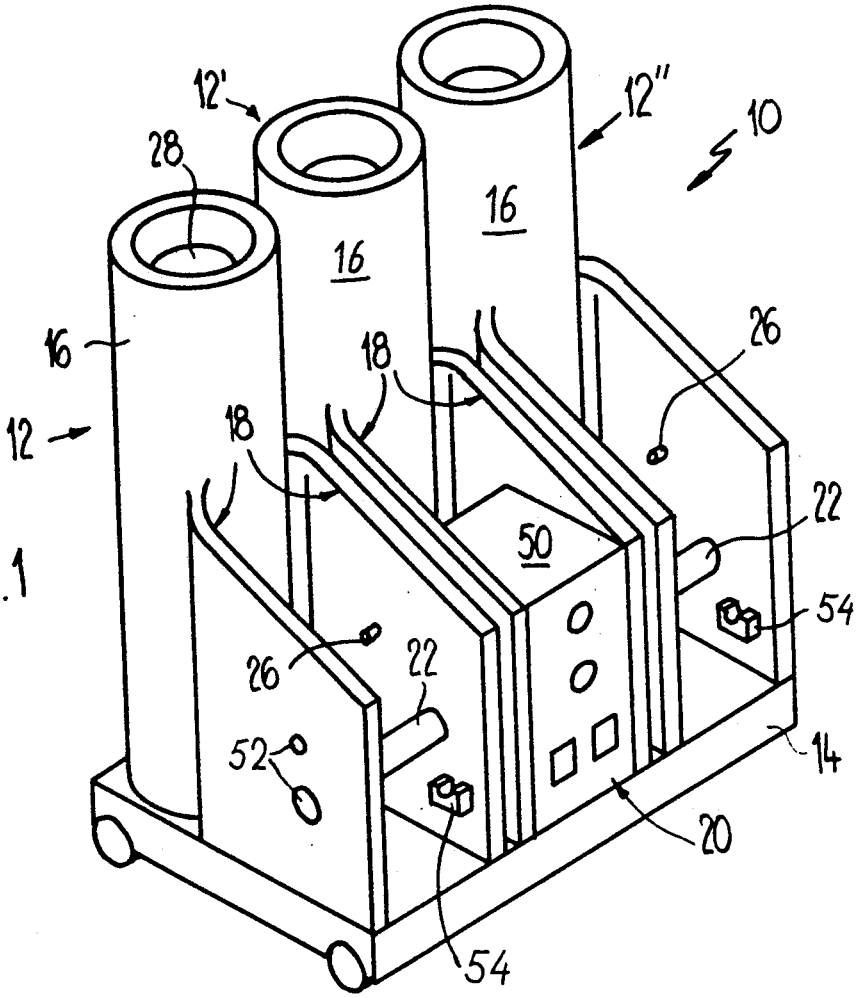
Fig.1
Fig.2
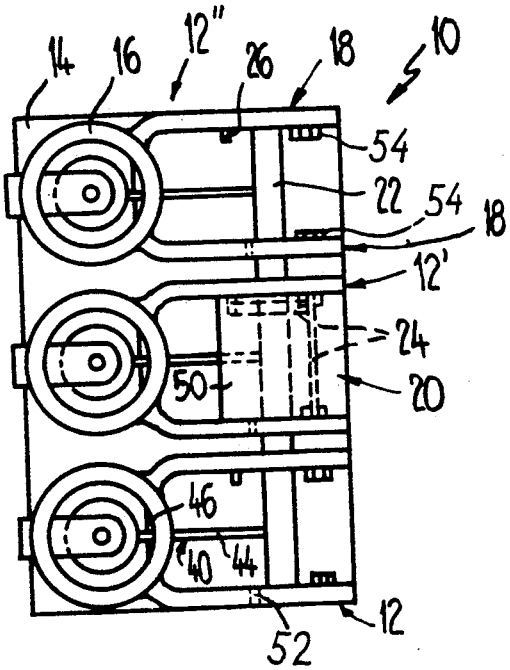
Fig.3
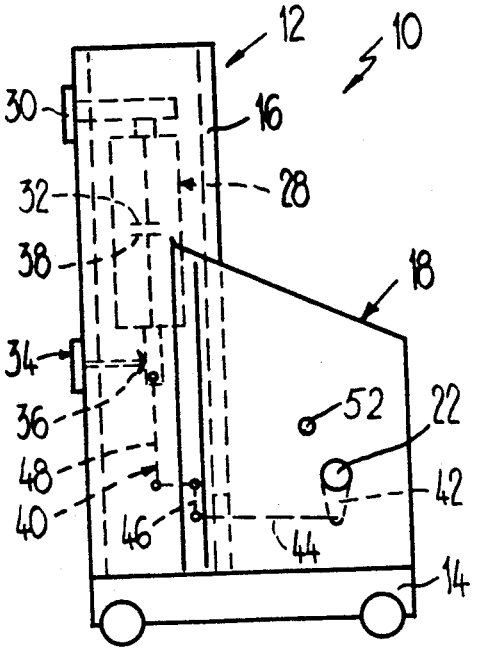

VACUUM SWITCH ARRANGEMENT

FIELD OF THE INVENTION

A switch arrangment including three identical insulating support frames, each having a tubular insulating housing with a vacuum switching tube.

BACKGROUND OF THE INVENTION

A switch arrangement is known from U.S. Pat. No. 4,587,390. This arrangement includes a housing which contains a spring force drive on which three tubular insulating support frames are arranged to stand. In each insulating support frame, a vacuum switching tube is mounted, the contacts of which are connected to one connection conductor, each which penetrates the respective insulating support frame in the radial direction. In the housing of the spring force drive, two parallel shields are provided which are laterally spaced apart and on which the drive parts of the spring force drive are supported. Each moving contact of the vacuum switching tubes is effectively connected via one linkage, each to the output member of the spring force drive which is common to all poles. This switch arrangement includes many individual parts and is expensive in its construction and assembly.

Furthermore, a vacuum switch arrangement with a mobile framework is known from EP Patent Specification 0,060,051 which corresponds to U.S. Pat. No. 4,449,021. On this framework, a single-piece insulating support frame is mounted backwards, which includes three adjacently arranged recessed which are open towards the front and in which one vacuum switching tube is mounted in each recess. On the framework, a housing is also mounted in which a drive is arranged, the output part of which is effectively connected via one linkage, each to the moving contact of each vacuum switching tube, a double lever of each linkage being supported on extensions of the insulating support frame. Although the insulating support frame is handling several functions, the construction of the entire switch arrangement is still expensive.

SUMMARY OF THE INVENTION

It is therefore an object of the present invention to create a switch arrangement which is simple in it, configuration, includes few parts and can be produced with little expenditure.

Thus, the insulating support frame is not only an insulating support element for the vacuum switching tube, but it is also a fixed component of the drive. The drive and the insulating support frame thus form a functional unit which are inseparable.

The production of the switch arrangement is particularly simplified by producing the insulating support frame, the support elements of support shells, stops, pins and so forth directly molded in or on, sprayed in or on or foamed around or on the support part.

By the invention, the linkages only need to absorb small forces, which allows a simple construction, and a pole-by-pole assembly is made possible.

An embodiment which is particularly advantageous with respect to production and economy is obtained by having each pole exhibiting an identical insulating support frame, in which arrangement, however, the drive parts of the spring force drive are preferably not supported at all by support parts of all insulating support frames. Thus, it is advantageous, for example, to arrange drive parts at the support part of the insulating support frame of a single pole and to support the output member additionally on support parts of the other poles. However, this embodiment also allows drive parts to be supported at support parts of insulating support frames of various poles.

One embodiment allows both the vacuum switching tubes, the transmission linkages and the spring force drive to be attached or supported at the insulating support frame, which reduces the number of parts needed and simplifies assembly and adjustment work.

BRIEF DESCRIPTION OF THE DRAWINGS

The invention will now be described in greater detail with reference to an illustrative embodiment shown in the drawings, in which, purely diagrammatically:

FIG. 1 illustrates a perspective view of a three-pole switch arrangement, and

FIGS. 2 and 3 illustrate a top view and side view, respectively, of a three-pole switch arrangement in a simplified form.

DETAILED DESCRIPTION OF THE PREFERRED EMBODIMENTS

The three-pole switch arrangement 10 exhibits three identical one-piece insulating support frames 12, 12', 12'' which are mounted on a plate-shaped mobile metal framework 14. EAch insulating support frame 12, 12', 12'' consists of a tubular insulating housing 16 standing on the framework 14 and two mutually parallel insulating wall elements 18 which are laterally spaced apart from one another approximately by the diameter of the insulating housing 16 and which project away from the insulating housing 16 in an approximately tangential direction.

Between the insulating wall elements 18 of the center insulating support frame 12', a spring force drive 20, which in generally known in its fundamental construction, is provided, the output shaft 22 of which, however, is supported at the insulating wall elements 18 of all three insulating support frames 12, 12', 12''.

As is indicated diagrammatically, particularly in FIG. 2, however, the other drive parts 24 such as shafts, pawls, springs and so forth of the spring force drive 20 are also supported or braced at the insulating wall elements 18 of the insulating support frame 12'. It must be noted in this connection that the support elements, such as pins 26, holes 52, support shells 54 and the like for the drive parts 24 are molded on or cast in or sprayed in at the insulating wall elements 18 all insulating support frames 12, 12', 12''. However, only all support elements 26, 52, 54 of the center insulating support frame 12' are needed for the spring force drive 20, whilst of the support elements 26, 52 and 54 provided at the insulating support frames 12, and 12'', only those for the output shaft 22 are used.

In each insulating housing 16, a vacuum switching tube 28 is arranged, each of which is held by a first connecting conductor 30 which is cast in the insulating housing 16 and which is electrically connected to the fixed switching contact 32 of the vacuum switching tube 28 (see, particularly, FIG. 3). The second connecting conductor 34 in each case which is also cast in the insulating housing 16 includes a slip contact 36, when diagrammatically, which is electrically connected to the moving switching contact 38 of the vacuum switching tube 28. The connecting conductors 30, 34 project past the insulating housing 16 on the side facing away from the insulating wall elements 18. Parts of isolating contacts, not shown, can be attached to these, for example, in order to connect or disconnect the switch arrangement 10 to or from the further isolating contact parts arranged in the switching cells.

The moving switching contact 38 of each vacuum switching tube 28 is effectively connected to the output shaft 22 of the spring force drive 20 via a linkage 40. Approximately in the center of the two insulating wall elements 18 of each insulating support frame 12, 12', 12'', a lever 42 is arranged fixed in rotation on the output shaft 22, the free end of each lever is connected via a push rod 44 to one lever arm of an angle lever 46 which is pivotably supported at the insulating support frame 12, 12', 12'' and the other lever arm of which is effectively connected to the moving switching contact 38 be means of an insulating rod 48.

As can be seen well, particularly from FIG. 1, the insulating wall elements 18 of the insulating support frame 12' also form the side walls of the spring force drive 20, the front and rear wall and cover of which are formed by a removable wall element 50, at the front part of which openings are provided for operating and display elements.

These operating and display elements and the control elements needed in a spring force drive 20 such as auxiliary switches, contactors and the like and terminal rows for connecting these control elements to control and signaling lines, can also be attached to the insulating wall elements 18.

It is also conceivable that individual drive parts are mounted or supported on the framework 14. However, all drive parts are advantageously arranged at the insulating wall elements 18 or at support elements mounted on these insulating wall elements 18 so that the entire spring force drive 20 can be mounted on the insulating support frame 12' and this constructional unit is then mounted on the framework 14 and is possibly screwed to the insulating support frame 12.

It is also possible that drive parts 24 are allocated to various insulating support frames 12, 12', 12'', so that the drive 20 is distributed over all three poles.

It is also possible that a single insulating support frame accommodated the vacuum switching tubes 28 of all poles and a support part or several support parts for supporting drive part are provided at this single insulating support frame.

I claim:

1. A switch arrangement comprising:

at least one insulating support frame, at least one vacuum switching tube arranged on said at least on insulating supporting frame, said at least one insulating support frame at least partly surrounds said at least one vacuum switching tube, two parallel support parts laterally spaced apart from one another being and projecting from each of said at least one insulating support frame.

a spring force drive with an output member and with drive parts supported on said two parallel support parts of said at least one insulating support frame, and at least one linkage connecting said output member of said spring force drive to a moving switching contact of each said at least one vacuum switching tube for driving said moving contact into engagement with a fixed switching contact.

2. A switch arrangement as claimed in claim 1, wherein support elements for said drive parts are firmly anchored in said two parallel support parts.

3. A switch arrangment as claimed in claim 1, wherein each of said at least one insulating support frame are identical and one insulating supporting frame is provided for each pole of a multi-pole switch arrangement and said drive parts are supported at only one set of said two parallel support parts provided for each insulating support frame.

4. A switch arrangement as claimed in claim 3, wherein said at least one insulating support frame are connected to one another.

5. A switch arrangement as claimed in claim 1, wherein said at least one insulating support frame is attached to an electrically conductive framework.

6. A switch arrangement as claimed in claim 1, wherein said at least one insulating support frame includes at least one tubular insulating housing each having one of said at least one vacuum switching tube and said two parallel support parts are formed by two insulating wall elements laterally projecting from said at least one insulating housing.

* * * * *